252-99 AU 257/5 EX
12/18/79 XR 4,179,390

United States Patent [19]
Spadini et al.
[11] 4,179,390
[45] Dec. 18, 1979

[54] LAUNDRY ADDITIVE PRODUCT

[75] Inventors: Gianfranco L. Spadini; Ian D. Tolliday, both of Newcastle upon Tyne, England

[73] Assignee: The Procter & Gamble Company, Cincinnati, Ohio

[21] Appl. No.: 839,490

[22] Filed: Oct. 4, 1977

[30] Foreign Application Priority Data

Oct. 6, 1976 [GB] United Kingdom ..... 41491/76
May 13, 1977 [GB] United Kingdom ..... 20213/77

[51] Int. Cl.[2] ..... C11D 3/395; C11D 7/54
[52] U.S. Cl. ..... 252/95; 252/99; 252/91; 252/DIG. 11; 252/DIG. 15; 427/212; 427/213; 427/222; 427/242; 428/131; 428/136; 428/137
[58] Field of Search ..... 252/99, 95, 91; 427/212, 213, 222, 242; 428/131, 136, 137

[56] References Cited

U.S. PATENT DOCUMENTS

| | | | |
|---|---|---|---|
| 2,955,905 | 10/1960 | Davies | 252/99 X |
| 3,185,649 | 5/1965 | Harpson et al. | 252/91 X |
| 3,532,634 | 10/1970 | Woods | 252/95 |
| 3,686,025 | 8/1972 | Morton | 252/91 X |
| 3,925,234 | 12/1975 | Hachmann et al. | 252/99 X |
| 3,944,694 | 3/1976 | McOueary | 428/136 |
| 3,956,556 | 5/1976 | McOueary | 428/136 |

*Primary Examiner*—Mayer Weinblatt

[57] ABSTRACT

Additive products for use in the washing of textiles are provided comprising an organic peroxy bleach precursor on a non particulate solid substrate that can be added to conventional inorganic persalt containing detergent liquors to enhance their bleaching performance particularly at temperatures of 70° C. and below.

6 Claims, No Drawings

LAUNDRY ADDITIVE PRODUCT

FIELD OF THE INVENTION

This invention relates to the removal of stains from textiles and is especially concerned with laundry additive products incorporating an organic peroxy compound precursor. Such products can be added to laundering solutions containing conventional inorganic persalt-containing detergent products to improve the removal of bleachable stains.

BACKGROUND TO THE INVENTION

Textile materials, particularly those made from vegetable fibres such as cotton or linen and articles manufactured from them are generally washed by contacting the materials with a washing liquor containing the conventional detergent components such as soaps or synthetic detergents as well as builders of various kinds, alkaline salts and bleaching compounds.

In the most common method of treating textiles having bleachable stains, the liquor containing the textiles is heated from ambient temperature to a temperature close to that of boiling water, i.e. above 85° C., and held at this temperature for some time before being cooled and the textiles withdrawn. At temperature of 85° C. and above, the inorganic persalt bleaching compounds frequently incorporated in laundry detergents, i.e. sodium perborate and sodium percarbonate, have a high bleaching performance but this falls off rapidly at lower temperatures viz. at 70° C. and below, so that the full benefit of the bleach is not obtained if the washing temperature is not high enough. Modern automatic washing machines are provided with programmed cycles that contain a heat-up stage to a temperature above 85° C. (the so-called 'boil wash') but they include programs for lower temperature washing cycles to handle coloured and synthetic fabrics. With the increasing incidence of use of these fabrics and the publicity accorded to energy conservation measures there is a tendency for the use of such lower temperature cycles to increase at the expense of the boil wash. Consequently there is a developing need for products having good bleaching ability in the temperature range of 70° C. and below, both to maintain cleaning performance in the low temperature cycles and to make the most effective use of an expensive ingredient.

Bleaching agents which are effective at low temperatures have been known for many years, most being capable of releasing organic peracids as the bleaching species.

Examples of detergent compositions incorporating bleaching agents of this type are disclosed by Reichert et al. U.S. Pat. No. 2,362,401 issued Nov. 7, 1944, Moyer U.S. Pat. No. 3,639,248 issued Feb. 1, 1972 and British Pat. Nos. 836,988 and 855,735.

These and other similar disclosures teach the incorporation of an organic precursor material into the formulation that reacts with the inorganic peroxy bleach component in the washing solution to give an organic peroxy bleach species, normally a peroxy acid. This peroxy bleach species is more effective in the lower temperature portions of the washing operation than the inorganic peroxy bleach. However products containing such combinations of organic peroxy compound precursors and inorganic peroxy bleaches have proved difficult to formulate for the reason that in the presence of moisture picked up during storage prior to use, these materials react to give the organic peroxy species which thereupon decomposes. This results in a lowered efficacy of the product.

Various methods have been proposed to achieve satisfactory stability of organic peroxy bleaching agents or of their precursors in detergent compositions, involving separate packaging as in Woods U.S. Pat. No. 3,532,634 issued Oct. 6, 1970: encapsulation as in Woods (supra), Lund & Neilsen U.S. Pat. No. 3,494,787 and Neilsen U.S. Pat. No. 3,494,786 both issued Feb. 10, 1970; coating as in Scheifer et al. U.S. Pat. No. 3,441,507 issued Apr. 29, 1969; and granulation as in Moyer et al. U.S. Pat. No. 3,639,248 issued Feb. 1, 1972. All of these methods are directed to the stabilisation of an organic peroxy bleaching agent or its precursor in a detergent product environment so as to provide the convenience of a single product, albeit with the limitation of the use of a fixed level of the bleaching species relative to the other detergent components on each occasion of use of the detergent. Attempts to improve the stability of the peroxy bleach or a precursor thereof in prior art compositions resulted in considerable inhibition of the release of the bleach into solution and thereby diminished effectiveness and increased cost.

Thus one disadvantage of the products of the prior art has been that they constitute costly formulations that lead to unnecessary and potentially damaging usage of bleach under certain circumstances.

A further disadvantage of the prior art products has been the difficulty of preventing fabric colour damage, particularly pin-point spotting, caused by direct contact of the textiles with undissolved particles of organic peroxy bleach per se and/or local concentrations or organic peroxy bleach in the immediate vicinity of precursor particles.

A yet further disadvantage associated with prior art products has been the potential for skin and internal tissue damage to humans arising from misuse or accidental ingestion under conditions in which reaction of the inorganic persalt and the organic precursor could occur to provide the highly reactive organic peroxy bleach species.

Accordingly one object of the present invention is the avoidance of these disadvantages by the incorporation of the bleaching agent precursor in an additive product in which the precursor is chemically and physically stable and is spatially separated from an inorganic peroxy bleach, the product being adapted for addition at any desired level to textile fabrics either before or during a washing operation in which conventional detergent compositions are employed. The present invention also seeks to maximise the effectiveness of the bleaching species by providing the bleaching agent precursor in a product form from which the precursor dissolves very rapidly into the aqueous washing liquor.

Another object of the invention is the provision of an additive product adapted to give enhanced bleachable stain removal particularly at temperatures of 70° C. and below when added to a solution containing inorganic peroxy salts.

SUMMARY OF THE INVENTION

According to one aspect of the present invention there is provided a laundry additive product comprising (a) A substrate in the form of a non-particulate solid article, in water-releasable combination with (b) an organic peroxy compound precursor wherein the weight ratio of the precursor to the substrate lies in the range of 30:1 to 1:10.

In a further aspect of the invention, a method of making a laundry additive product comprises the steps of forming the peroxy compound precursor into a fluid mass, impregnating a solid non-particulate article with said mass and causing said mass to solidify.

As used herein, an organic peroxy compound precursor is any organic compound capable of reaction with an inorganic peroxygen-containing compound in aqueous solution to give an organic peroxy compound having a bleaching performance at least equivalent to that of the inorganic peroxygen containing compound at a temperature of 70° C. and below, under the same condition.

Preferred materials for the purpose of the present invention are those which require a titre of at least 2.0 mls 0.01M sodium thiosulphate in the perhydrolysis test defined hereinafter.

Also as used herein the terms inorganic peroxy bleach and inorganic persalt are intended to cover salts such as alkali metal perborates, percarbonates, persilicates and perpyrophosphates which product hydrogen peroxide in aqueous solution rather than compounds such as persulphates and permanganates which produce other peroxy species.

For the purposes of this invention water-releasable combination is taken to mean a combination capable of being separated by water through solution, dispersion, leaching, softening or melting.

In one preferred aspect of the invention the organic peroxy compound precursor or each of the components of a mixture of such precursors is selected from the group consisting of anhydrides, esters, oximes and N-acylated compounds. Preferably the precursor is one or more N-acetylated compounds of structure:

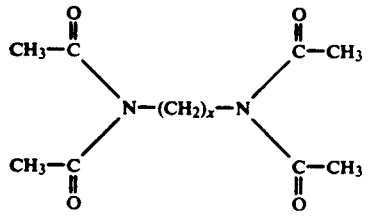

where x can be 0 or any integer between 1 and 6 and is most preferably 1, 2 or 6.

Preferably also the article is in the form of a flexible sheet substrate wherein the weight ratio of the precursor to the substrate lies in the range 10:1 to 1:10.

The additive products of the invention are designed to be introduced into the washing machine with the soiled fabrics, or at the beginning of the wash cycle in programmed drum machines. Thus the precursor and inorganic peroxy bleach compounds contained in the washing composition do not come into contact with each other except in the washing liquor. The delivery of the precursor to the wash liquor in water-releasable combination with a non-particulate solid article permits avoidance of stability problems associated with the incorporation of peroxy bleach precursors in conventional granular formulations and also permits control by the user of whether or not low temperature bleaching is to be employed and the level of organic peroxy bleach that is to be used. The additive products of the present invention also provide enhanced safety to users by the physical separation of the key components and by materially increasing the difficulty of accidental ingestion of the combination.

The present invention also provides an enhanced rate of dissolution of the peroxy compound precursor in the wash liquor relative to that achieved from prior art granular products and this, in turn, improves the rate of conversion into the organic peroxy bleaching species. The overall performance efficiency of the organic peroxy compound is thereby improved and the harmful effects of catalase on the bleaching capability of residual inorganic peroxy bleach are reduced.

In its preferred aspects the invention also provides an efficaceous means of delivering a soil removal benefit to fabrics over a range of stains including those arising from grease and oil and proteinaceous soils.

DETAILED DESCRIPTION OF THE INVENTION

As described above the invention in its broadest form comprises two components, namely an organic peroxy compound precursor in water releasable combination with a non particulate solid article serving as a substrate.

The Organic Peroxy Compound Precursor

Organic peroxy compound precursors, or inorganic per salt activators as they are usually known, are well known in the art and are described extensively in the literature.

Examples of various classes of peroxy compound precursors include (a) Anhydrides These can be aliphatic, aromatic or mixed and can be derived from mono or polycarboxylic acids. Preferred aliphatic anhydrides have individual aliphatic groups containing 1–12 carbon atoms and mixed aliphatic anhydrides should contain no more than 20 carbon atoms. Specific aliphatic anhydrides include acetic, propionic, butyric, heptanoic, nonanoic, acetic-hexadecanoic, acetic-stearic and butyric-myristic anhydrides.

Aromatic anhydrides can be substituted or unsubstituted, preferred examples being benzoic, phthalic and pyromellitic anhydrides and their nucleosubstituted halo, nitro and alkoxy analogues such as 2,4-dichloro benzoic anhydride, m-chloro benzoic anhydride and p-methoxy benzoic anhydride.

Mixed aliphatic-aromatic anhydrides are also useful in the present invention provided that they contain no more than 12 carbon atoms in the molecule, examples being benzoic-acetic anhydride and benzoic propionic anhydride. Other useful anhydrides include the cyclic anhydrides such as maleic, succinic, glutaric, adipic and itaconic anhydrides and polymeric anhydrides such as polyadipic and polyazelaic polyanhydrides of formula

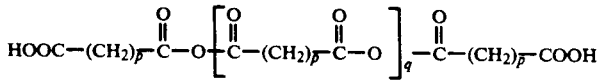

wherein p is preferably 4 to 7 and q has a value between 5 l and 15 preferably 7 to 8.

Reichert U.S. Pat. No. 2,362,401 issued Nov. 7, 1944 describes the use of certain of organic anhydrides as perborate activators in detergent compositions and is hereby specifically incorporated by reference.

(b) Esters

Esters suitable as peroxy compound precursors in the present invention include esters of monohydric substituted and unsubstituted phenols, substituted aliphatic alcohols in which the substituent group is electron withdrawing in character, mono- and disaccharides, N-substituted derivatives of hydroxylamine and esters of imidic acids. The phenyl esters of both aromatic and aliphatic mono- and dicarboxylic acids can be employed. The aliphatic esters can have 1 to 20 carbon atoms in the acyl group, examples being phenyl acetate, phenyl laurate, phenyl myristate, phenyl palmitate and phenyl stearate. Of these, o-acetoxy benzoic acid and methyl o-acetoxy benzoate are especially preferred. Diphenyl succinate, diphenyl azeleate and diphenyl adipate are examples of phenyl aliphatic dicarboxylic acid esters. Aromatic esters include phenyl benzoate, diphenyl phthalate and diphenyl ispophthalate.

A specific example of an ester of a substituted aliphatic alcohol is trichloroethyl acetate. Examples of saccharide esters include glucose penta-acetate and sucrose octa-acetate. An exemplary ester of hydroxylamine is acetyl aceto hydroxamic acid.

These and other esters suitable for use as peroxy compound precursors in the present invention are fully described in British Pat. Specification Nos. 836,988 and 839,715 the disclosures of which are hereby specifically incorporated by reference.

A further group of esters are the acyl phenol sulphonates and acyl alkyl phenol sulphonates. Examples of the former include sodium acetyl phenol sulphonate (alternatively described as sodium p-acetoxy benzene sulphonate) and sodium benzoyl phenol sulphonate (alternatively described as sodium p-benzoyloxy benzene sulphonate) Examples of acyl alkyl phenol sulphonates include sodium 2-acetoxy 5-dodecyl benzene sulphonate, sodium 2-acetoxy 5-hexyl benzene sulphonate and sodium 2-acetoxy capryl benzene sulphonate. The preparation and use of these and analogous compounds is given in British Pat. Specification Nos. 963,135 and 1,147,871 both specifically incorporated herein by reference.

Acetylated esters of phosphoric acid have also been suggested as organic peroxy compound precursors, examples being diethyl monoacetyl orthophosphate and diacetyl ethyl orthophosphate.

Esters of imidic acids have the general formula

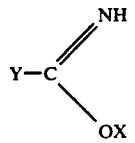

wherein X is substituted or unsubstituted $C_1$–$C_{20}$ alkyl or aryl and Y can be the same as X and can also be $—NH_2$. An example of this class of compounds is ethyl benzimidate wherein Y is $C_6H_5$ and X is ethyl.

Other specific esters include p-acetoxy acetophenone and 2,2-di-(4-hydroxyphenyl) propane diacetate. This last material is the diacetate derivative of 2,2-di(4-hydroxyphenyl) propane more commonly known as Bisphenol A which is an intermediate in the manufacture of polycarbonate resins. Bisphenol A diacetate and methods for its manufacture are disclosed in German DAS No. 1,260,479 published Feb. 8, 1968 in the name of VEB Chemiefaserwerk Schwarza "Wilhelm Piesh" the disclosures of which are hereby incorporated by reference.

(c) Imides

Imides suitable as organic peroxy compound precursors in the present invention are compounds of formula

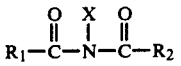

in which $R_1$ and $R_2$, which can be the same or different are independently chosen from a $C_1$–$C_4$ alkyl group or an aryl group and X is an alkyl, aryl or acyl radical (either carboxylic or sulphonic). Typical compounds are those in which $R_1$ is a methyl, ethyl, propyl or phenyl group but the preferred compounds are those in which $R_2$ is also methyl, examples of such compounds being N,N-diacetylaniline, N,N-diacetyl-p-chloroaniline and N,N-diacetyl-p-toluidine. Either one of $R_1$ and $R_2$ together with X may form a heterocyclic ring containing the nitrogen atom. An illustrative class having this type of structure is the N-acyl lactams, in which the nitrogen atom is attached to two acyl groups, one of which is also attached to the nitrogen in a second position through a hydrocarbyl linkage. A particularly preferred example of this class is N-acetyl caprolactam. The linkage of the acyl group to form a heterocyclic ring may itself include a heteroatom, for example oxygen, and N-acyl saccharides are a class of precursors of this type.

Examples of cyclic imides in which the reactive centre is a sulphonic radical are N-benzene sulphonyl phthalimide, N-methanesulphonyl succinimide and N-benzene sulphonyl succinimide. These and other N-sulphonyl imides useful herein are described in British Pat. Specification No. 1,242,287 the disclosures of which are hereby incorporated by reference.

Attachment of the nitrogen atoms to three acyl groups occurs in the N-acylated dicarboxylic acid imides such as the N-acyl phthalimides, N-acyl succinimides, N-acyl adipimides and N-acyl glutarimides. Imides of the above-mentioned types are described in British Pat. Specification No. 855,735 the disclosures of which are hereby incorporated specifically herein by reference.

Two further preferred groups of materials in this class are those in which X in the above formula is either a second diacylated nitrogen atom ie. substituted hydrazines, or a difunctional hydrocarbyl group such as a $C_1$–$C_6$ alkylene group further substituted with a diacylated nitrogen atom i.e. tetra acylated alkylene diamines.

Particularly preferred compounds are N,N,N',N'-tetra acetylated compounds of formula

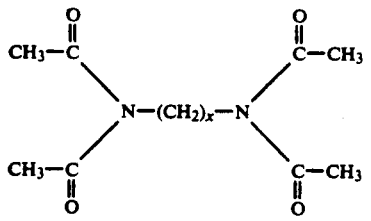

in which x can be 0 or an integer between 1 and 6, examples are tetraacetyl methylene diamine (TAMD) where x=1, tetraacetyl ethylene diamine (TAED) where x=2, and tetraacetyl hexamethylene diamine (TAHD) where x=6. Where x=0 the compound is tetraacetyl hydrazine (TAH). TAHD and TAMD are particularly preferred because of their low melting points (59° C. and 83° C. respectively) which facilitates their processing in additive products of the present invention as described hereinafter. These and analogous compounds are described in British Pat. Specification Nos. 907,356, 907,357 and 907,358 the disclosures of which are specifically incorporated herein by reference.

Acylated glycourils form a further group of compounds falling within the general class of imide peroxy compounds precursors. These materials have the general formula

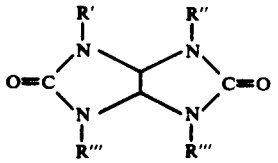

in which at least two of the R groups represent acyl radicals having 2 to 8 carbon atoms in their structure. The preferred compound is tetra acetyl glycouril in which the R groups are all $CH_3CO$— radicals, The acylated glycourils are described in British Pat. Specification Nos. 1,246,338, 1,246,339, 1,248,817 and 1,247,429, the disclosures of which are specifically incorporated herein by reference.

Other imide-type compounds suitable for use as peroxy compound precursors in the present invention are the N-(halobenzoyl) imides disclosed in British Pat. Specification No. 1,247,857, of which N-m-chloro benzoyl succinimide is a preferred example, and poly imides containing an N-bonded-COOR group, eg. N-methoxy carbonyl phthalimide, disclosed in British Pat. Specification No. 1,244,200 both of which disclosures are hereby specifically incorporated herein by reference.

N-acyl and N,N'-diacyl derivatives of urea are also useful peroxy compound precursors for the purposes of the present invention, in particular N-acetyl dimethyl urea, N,N'-diacetyl ethylene urea and N,N'-diacetyl dimethyl urea. Compounds of this type are disclosed in Netherlands patent application No. 6,504,416 published October 10, 1966 which disclosure is hereby specifically incorporated herein by reference. Other urea derivatives having inorganic persalt activating properties are the mono- or di-N-acylated azolinones disclosed in British Pat. Specification No. 1,379,530 specifically incorporated herein by reference.

Acylated hydantoin derivatives also fall within this general class of organic peroxy compound precursors. The hydantoins may be substituted eg. with lower alkyl groups and one or both nitrogen atoms may be acylated. Examples of compounds of this type are N-acetyl hydantoin, N,N-diacetyl, 5,5-dimethyl hydantoin, 1-phenyl, 3-acetyl hydantoin and 1-cyclohexyl, 3-acetyl hydantoin. These and similar compounds are described in British Pat. Specification Nos. 965,672 and 1,112,191, the disclosures of both of which are specifically incorporated herein by reference.

Another class of nitrogen compounds of the imide type are the N,N-diacyl methylene diformamides of which N,N-diacetyl methylene diformamide is the preferred member. This material and analogous compounds are disclosed in British Pat. Specification No. 1,106,666 also specifically incorporated herein by reference.

(d) Cyano Compounds

A further class of organic compounds suitable as peroxy compound precursors in the present invention are those having the general formula

X—C≡N wherein X can be a substituted or unsubstituted alkyl or aryl group or can be

—C(=O)—A wherein A is —OR or —$NR_1R_2$, each of $R_1R_1$ and $R_2$ being a lower alkyl or a substituted or unsubstituted aryl group.

This class of compounds differs from most of the other peroxy compound precursors in that the reaction with inorganic persalts forms peroxy species other than peroxy acids.

Where X is a substituted or unsubstituted alkyl or aryl group, the compounds are nitriles, which may be mono or poly-functional in type and whose efficacy increases as the number of cyano groups increases, provided that the compounds retain some solubility in watre. Specific examples of organo-nitriles include phthalonitrile, benzonitrile, tetramethylene dinitrile, malonitrile, ethylene diamino tetra acetic dinitrile, nitrilo triacetic nitrile and succinonitrile. These and other similar compounds useful herein are fully described in British Patent Specification No. 802035 the disclosures of which are specifically incorporated herein by reference.

Compounds of the above formula in which X is —COOR or —$CONR_1R_2$ are disclosed in German patent application OLS No. 2,647,978 published April 28, 1977 and incorporated herein by reference.

(e) Imidazoles

N-acyl imidazoles and similar five-membered ring systems form a further series of compounds useful as inorganic peroxy compound precursors. Specific examples are N-acetyl benzimidazole, N-benzoyl imidazole and its chloro- and methyl-analogues. Compounds of this type are disclosed in British Pat. Specification Nos. 1,234,762, 1,311,765 and 1,395,760 the respective disclosures of which are hereby specifically incorporated by reference.

(f) Oximes

Oximes and particularly acylated oximes are also a useful class of organic peroxy compound precursors for the purpose of this invention. Oximes are derivatives of hydroxylamine from which they can be prepared by reaction with aldehydes and ketones to give aldoximes and ketoximes respectively. The acyl groups may be $C_1$–$C_{12}$ aliphatic or aromatic in character, preferred acyl groups being acetyl, propionyl, lauroyl, myristryl and benzoyl. Compounds containing more than one carbonyl group can react with more than one equivalent of hydroxylamine and the commonest class of dioximes are those derived from 1,2-diketones and ketonic aldehydes, such as dimethyl glyoxime

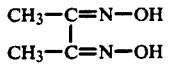

The acylated derivatives of this compound are of particular value as organic peroxy compound precursors, examples being diacetyl dimethyl glyoxime, dibenzoyl dimethyl glyoxime and phthaloyl dimethyl glyoxime.

(g) Carbonates

Substituted and unsubstituted aliphatic, aromatic and alicyclic esters of carbonic and pyrocarbonic acid have also been proposed as organic peroxy compound precursors. Typical examples of such esters are p-carboxy phenyl ethyl carbonate, sodium-p-sulphophenyl ethyl carbonate, sodium-p-sulphophenyl n-propyl carbonate and diethyl pyrocarbonate. The use of such esters as inorganic persalt activators in detergent compositions is set forth in British Pat. Specification No. 970,950 to the disclosures of which are hereby specifically incorporated by reference.

In addition to the foregoing classes, numerous other materials can be utilised as organic peroxy compound precursors including triacyl guanidines of formula

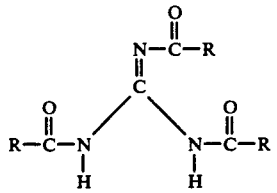

wherein R is alkyl, preferably acetyl or phenyl, prepared by the acylation of a guanidine salt. Other classes of compounds include acyl sulphonamides, eg. N-phenyl N-acetyl benzene sulphonamide as disclosed in British Pat. Specification No. 1,003,310 and triazine derivatives such as those disclosed in British Pat. Specification Nos. 1,104,891 and 1,410,555. Particularly preferred examples of triazine derivatives are the di- and triacetyl derivatives of 2,4,6,trihydroxy 1,3,5-triazine, 2-chloro 4,6-dimethoxy-S-triazine and 2,4-dichloro 6-methoxy-S-triazine. Piperazine derivatives such as 1,4-diacylated 2,5-diketo piperazine as described in British Pat. Specification Nos. 1,339,256 and 1,339,257 are also useful as are water soluble alkyl and aryl chloroformates such as methyl, ethyl and phenyl chloroformate disclosed in British Pat. Specification No. 1,242,106. The foregoing disclosures are all hereby specifically incorporated herein by reference.

Of the foregoing classes of activators, the preferred classes are those that produce a peroxycarboxylic acid on reaction with an inorganic persalt. In particular the preferred classes are the anhydrides, imides, oximes and esters especially the phenol esters and imides.

Specific preferred materials include methyl o-acetoxy benzoate, sodium-p-acetoxy benzene sulphonate, Bisphenol A diacetate, tetraacetyl ethylene diamine, tetra acetyl hexamethylene diamine and tetra-acetyl methylene diamine.

The amount of the peroxy compound precursor applied to the substrate is arranged such that the precursor: substrate ratio is within the range 30:1 to 1:10 more usually 10:1 to 1:10 by weight. Conveniently, precursor:substrate weight ratios lie within the range 8:1 to 1:2 and most preferably within the range 5:1 to 1:1.

The level of usage of organic peroxy compound precursor will naturally be dependent on a number of factors e.g. the size of the fabric load in the machine, the level of bleaching performance desired, the amount of inorganic persalt in the conventional detergent product and the usage of the detergent product, the bleaching efficacy of the organic peroxy species derived from the precursor and the efficiency of conversion of the precursor into that peroxy species. It is conventional with inorganic peroxy bleaches to provide a level of available oxygen in solution of from 50 ppm to 350 ppm by weight for heavy duty laundry purposes. However, when using organic peroxy bleaches a level of available oxygen provided by the organic peroxy compound should be in the range 10 ppm to 80 ppm. This level of available oxygen should be attained within the normal wash cycle time i.e. within 15–25 minutes depending on the particular wash cycle being employed.

For a machine having a liquid capacity in use of 20 to 30 liters, such a level of available oxygen requires the delivery of from 1 gr to 20 gr of organic peroxy compound precursor assuming quantitative conversion. This figure will increase proportionately with any decrease in the efficiency of conversion. Preferably a single unit of substrate should be capable of accommodating this level of precursor and any adjuvants and additives that it is necessary to incorporate into the product although the number of units to be used to deliver a given quantity of precursor is a matter of choice. Normally the weight of precursor per delivery will lie in the range 3 to 10 grs, preferably from 4 to 6 grs.

Substrate

The present invention requires that the peroxy compound precursor be in water-releasable combination with a substrate comprising a non-particulate solid article. The substrate may itself be water soluble or water insoluble and in the latter case it should possess sufficient structural integrity under the conditions of the wash to be recovered from the machine at the end of the laundry cycle. Structures which are water disintegratable i.e. that break down in aqueous media to insoluble individual fibres or particles are not considered satisfactory for the purpose of the present invention.

Water soluble materials include certain cellulose ethers, alginates, polyvinyl alcohol and water soluble polyvinyl pyrrolidone polymers, which can be formed into non-woven and woven fibrous structures. Suitable water insoluble materials include, but are not restricted to, natural and synthetic fibres, foams, sponges and films.

The substrate may have any one of a number of physical forms such as sheets, blocks, rings, balls, rods or tubes. Such forms should be amenable to unit usage by the consumer, i.e. they should be capable of addition to the washing liquor in measured amounts, such as individual sheets, blocks or balls and unit lengths of rods or tubes. Certain of these substrate types can also be adapted for single or multiple uses, and can be provided with loadings of organic peroxy acid precursor up to a precursor:substrate ratio of 30:1 by weight.

One such article comprises a sponge material releasably enclosing enough organic peroxy compound precursor to provide bleaching action during several washing cycles. This multi-use article can be made by impregnating a sponge ball or block with about 20 grams of the precursor and any adjuncts therewith. In use, the precursor leaches out through the pores of the sponge into the wash liquor and reacts with the inorganic peroxy bleach. Such a filled sponge can be used to treat several loads of fabrics in conventional washing machines, and has the advantage that it can remain in the washer after use.

Other devices and articles that can be adapted for use in dispensing the organic peroxy compound precursor in a washing liquor include those described in Dillarstone, U.S. Pat. No. 3,736,668, issued June 5, 1973: Compa et al, US. Pat. No. 3,701,202, issued Oct. 31, 1972: Furgal, U.S. Pat. No. 3,634,947, issued Jan. 18, 1972: Hoeflin, U.S. Pat. No. 3,633,538, issued Jan. 11, 1972 and Rumsey, U.S. Pat. No. 3,435,537, issued Apr. 1, 1969. All of these patents are incorporated herein by reference.

A highly preferred article herein comprises the organic peroxy compound precursor in water-releasable combination with a sheet which should be flexible so as to make it compatible with the movement of the fabrics in the washing machine and to facilitate its handling during manufacture of the product. Preferably the sheet is water pervious i.e. water can pass from one surface of the sheet to the opposite surface and, for film type substrates, perforation of the sheet is desirable. The most preferred form of the substrate is a sheet of woven or non-woven fabric or a thin sheet of cellular plastic material. Woven fabric sheets can take the form of a plain weave natural or synthetic fibre of low fibre count/unit length, such as is used for surgical dressings, or of the type known as cheese cloth. Loading limitations on sheet type substrates limit the amount of precursor that can be applied to the sheet namely to a maximum represented by a precursor:sheet weight ratio of about 10:1.

A very desirable attribute of the laundry additive products of the present invention is that they do not interfere with the mechanical operation of the washing machine into which they are put. A high proportion of domestic washing machines are of the rotating perforated drum type in which the perforations extend over the entire peripherol surface. In this type of equipment the drum construction and mode of operation obviates any problem of obstruction to liquid flow in the machine. Certain older types of machine utilise an agitator in a stationary vessel provided with a recirculating liquid system. In order to avoid liquid blockage in this machine type it may be necessary to provide slits or perforations in the substrate, particularly if it is in sheet form. Sheet structure of this type are disclosed in McQueary U.S. Pat. Nos. 3,944,694 and 3,956,556 issued Mar. 16, 1976 and May 11, 1976 respectively, the disclosures of which are hereby incorporated herein by reference.

A desirable feature of a substrate to be utilised in the present invention herein is that it be absorbent in nature. It is known that most substances are able to absorb a liquid substance to some degree; however, the term "absorbent", as used herein, is intended to mean a substance with an absorbent capacity (i.e., values representing a substrate's ability to take up and retain a liquid) of up to approximately 12 times its weight of water.

Determination of absorbent capacity values is made by using the capacity testing procedures described in U.S. Federal Specification UU-T595b modified as follows:

(1) tap water is used instead of distilled water;
(2) the specimen is immersed for 30 seconds instead of 3 minutes;
(3) draining time is 15 seconds instead of 1 minute; and
(4) the specimen is immediately weighed on a torsion balance having a pan with turned-up edges.

Absorbent capacity values are then calculated in accordance with the formula given in said specification. Based on this test, one-ply, dense, bleached paper (e.g. kraft or bond having a basis weight of about 32 pounds per 3,000 square feet, has an absorbent capacity of 3.5 to 4; commercially available household one-ply towelling paper has a value of 5 to 6; and, commercially available two-ply household towelling paper has a value of 7 to about 9.5.

The substrate of this invention can also be defined in terms of "free space". Free space, also called "void volume", as used herein is intended to mean that space within a structure that is unoccupied. For example, certain multi-ply paper structures comprise plies embossed with protuberances, the ends of which are mated and joined; such a paper structure has a void volume of free space between the the unembossed portion of the plies, as well as between the fibres of the paper sheet itself. A non-woven cloth also has such space between each of its fibres. The free space of non-woven cloth or paper, having designated physical dimensions, can be varied by modifying the density of the fibres of the paper or non-woven cloth. Substrates with a high amount of free space generally have low fibre density; high density substrates generally have a low amount of free space. Preferred substrates of the invention herein have up to about 90% free space based on the overall volume of the substrate structure.

As stated above, suitable materials which can be used as a substrate in the invention herein include, among others sponges, paper, and woven and non-woven fabrics. The preferred substrates of the laundry additive products herein are cellulosic, particularly apertured and non-apertured non woven fabrics.

Specifically, one suitable substrate is a compressible, laminated, calendered, multi-ply absorbent paper structure. Preferably, the paper structure has 2 or 3 plies and a total basis weight of from 14 to 90 pounds per 3,000 square feet and absorbent capacity values within the range of 7 to 10. Each ply of the preferred paper structure has a basis weight of about 7 to 30 pounds, per 3,000 square feet, and the paper structure can consist of plies having the same or different basis weights. Each ply is preferably made from creped, or otherwise extensible, paper with creped percentage of about 15% to 40% and a machine direction (MD) tensile and cross-machine (CD) tensile of from about 100 to 1,500 grams per square inch of paper width. The two outer plies of a 3-ply paper structure or each ply of a 2-ply paper structure are embossed with identical repeating patterns consisting of about 16 to 200 discrete protuberances per square inch, raised to a height of from about 0.010 inch to 0.40 inch above the surface of the unembossed paper sheet. From about 10% to 60% of the paper sheet surface is raised. The distal ends (i.e. the ends away from the unembossed paper sheet surface) of the protuberances on each ply are mated and adhesively joined together, thereby providing a preferred paper structure exhibiting a compressive modulus of from about 200 to 800 inch-grams per cubic inch and Handle-O-Meter (HOM) MD and CD values of from about 10 to 130.

The compressive modulus values which define the compressive deformation characteristics of a paper structure compressively loaded on its opposing surfaces, the HOM values which refer to the stiffness or handle of a paper structure, the MD and CD HOM values which refer to HOM values obtained from paper structure samples tested in a machine and cross-machine direction, the methods of determining these values, the equipment used, and a more detailed disclosure of the paper structure preferred herein, as well as methods of its preparation, can be found in Edward R. Wells, U.S. Pat. No. 3,414,459, issued on Dec. 3, 1968, the full disclosure of which is hereby incorporated hereinto.

The preferred non-woven fabric substrates usable in the invention herein can generally be defined as adhesively bonded fibrous or filamentous products, having a web or carded fibre structure (where the fibre strength is suitable to allow carding) or comprising fibrous mats, in which the fibres or filaments are distributed haphazardly or in random array (i.e. an array of fibres in a carded web wherein partial orientation of the fibres is frequently present as well as a completely haphazard distributional orientation) or substantially aligned. The fibres or filaments can be natural (eg. wool, silk, wood pulp, jute, hemp, cotton, linen, sisal, or ramie), synthetic (eg. rayon, cellulose, ester, polyvinyl derivatives, polyolefins, polyamides, or polyesters) or mixtures of any of the above.

Methods of making non-woven cloths are not a part of this invention and being well known in the art, are not described in detail herein. Generally, such cloths are made by air or water laying processes in which the fibres or filaments are first cut to desired lengths from long strands, passed into a water or air stream, and then deposited onto a screen through which the fibre-laden air or water is passed. The deposited fibres or filaments are then adhesively bonded together, dried, cured and otherwise treated as desired to form the non-woven cloth. Non-woven cloths made of polyesters, polyamides, vinyl resins, and other thermoplastic fibres can be spunbonded, i.e. the fibres are spun out onto a flat surface and bonded (melted) together by heat or by chemical reactions.

The absorbent properties desired herein are particularly easy to obtain with non-woven cloths and are provided merely by building up the thickness of the cloth, i.e. by superimposing a plurality of carded webs or mats to a thickness adequate to obtain the necessary absorbent properties, or by allowing a sufficient thickness of the fibres to deposit on the screen. Any diameter or denier of the fibre (generally up to about 10 denier) can be used, inasmuch as it is the free space between each fibre that makes the thickness of the cloth directly related to the absorbent capacity of the cloth, and which further makes the non-woven cloth especially suitable for impregnation with a peroxy compound precursor by means of intersectional or capillary action. Thus, any thickness necessary to obtain the required absorbent capacity can be used.

The choice of binder-resins used in the manufacture of non-woven cloths can provide substrate possessing a variety of desirable traits. For example, the absorbent capacity of the cloth can be increased, decreased, or regulated by respectively using a hydrophilic binder-resin, a hydrophobic binder-resin or a mixture thereof in the fibre bonding step. Moreover, the hydrophobic binder-resin, when used singly or as the predominant compound of a hydrophobic-hydrophilic mixture, provides non-woven cloths which are especially useful as substrates when the precursor-substrate combinations disclosed herein are used in an automatic washer.

When the substrate herein is a non-woven cloth made from fibres, deposited haphazardly or in random array on the screen, the compositions exhibit excellent strength in all directions and are not prone to tear or separate when used in the washer.

Preferably, the non-woven cloth is water-laid or air-laid and is made from cellulosic fibres, particularly from regenerated cellulose or rayon, which are lubricated with standard textile lubricant. Preferably, the fibres are from 3/16" to 2" in length and are from 1.5 to 5 denier (Denier is an internationally recognised unit in yarn measure, corresponding to the weight in grams of a 9,000 meter length of yarn). Preferably, the fibres are at least partially oriented haphazardly, particularly substantially haphazardly, and are adhesively bonded together with hydrophobic or substantially hydrophobic binder-resin, particularly, with a nonionic self-crosslinking acrylic polymer or polymers. Conveniently, the cloth comprises about 70% fibre and 30% binder-resin polymer by weight and has a basis weight of from 10 to about 100, preferably 20–60 grammes per square yard.

A suitable example is an air-laid, non-woven cloth comprising 70% regenerated cellulose (American Viscose Corporation) and 30% hydrophobic binder-resins (Rhoplex HA-8 on one side of the cloth, Rhoplex HA-16 on the other; Rohm & Haas, Inc.). The cloth has a thickness of 4 to 5 mils., a basis weight of about 24 grams per square yard, and an absorbent capacity of 6. One foot length of the cloth 8 ⅓" wide, weighs about 1.78 grams. The fibres are ¼" in length, 1.5 denier, and are orientated substantially haphazardly. The fibres are lubricated with sodium oleate.

A further exemplary substrate is a water-laid, non-woven cloth commercially available from C. H. Dexter Co., Inc. The fibres are regenerated cellulose, about ⅜" in length, about 1.5 denier, and are lubricated with a similar standard textile lubricant. The fibres comprise about 70% of the non-woven cloth by weight and are orientated substantially haphazardly; the binder-resin (HA-8) comprises about 30% by weight of the cloth. The substrate is about 4 mils. thick, and it has a basis weight of about 24 grams per square yard and an absorbent capacity of 5.7. One foot length of the cloth, 8 ⅓" wide, weighs about 1.66 grams.

Apertured non-woven substrates are also useful for the purposes of the present invention. The apertures, which extend between opposite surfaces of the substrate are normally in a pattern and are formed during laydown of the fibres to produce the substrate. Exemplary apertured non-woven substrates are disclosed in U.S. Pat. Nos. 3,741,724, 3,930,086 and 3,750,237, the disclosures of which are specifically incorporated herein by reference.

One particularly suitable example of an apertured non-woven substrate is that obtainable from Chicopee Manufacturing Co., Milltown, New Jersey, U.S.A. under the Code NoSK 650 WFX 577 and comprising a polyester - wood pulp mixture having a basis weight of 50 grs/sq meter and approximately 13 apertures per sq. cm.

Another preferred example of an apertured non-woven substrate, also available from Chicopee Manufacturing Co., under the Code No. AK 30 ML 1379 comprises a regenerated cellulose sheet of 3.0 denier fibres bonded with Rhoplex RA 8 binder (fibre:binder ratio 70:30) having a basis weight of 40 grs/sq meter and 17 apertures/sq cm.

In general, apertured fabrics for the purposes of the invention have from 10–20 apertures/ sq cm preferably 12–18 apertures/sq cm.

A further class of substrate material that can be used in the present invention comprises an absorbent foam like material in the form of a sheet. The term absorbent foam-like material' is intended to encompass three dimensional absorptive materials such as 'gas blown foams', natural sponges and composite fibrous based structures such as are disclosed in U.S. Pat. Nos. 3,311,115 and 3,430,630 specifically incorporated herein by reference. A particularly suitable material of this type is a hydrophilic polyurethane foam in which the internal cellular walls of the foam have been broken by reticulation. Foams of this type are described in detail in Dulle U.S. Pat. No. 3,794,029 which is hereby specifically incorporated by reference. A preferred example of this foam type comprises a hydrophilic polyurethane foam of density about 0.596 grs. per cubic inch with a cell count of between 20 and 100 cells per inch, preferably about 60 to 80 per inch available from the Scott Paper Company, Eddystone, Pennsylvania USA., under the Registered Trade Mark "Hydrofoam".

The size and shape of the substrate sheet is a matter of choice and is determined principally by factors associated with the convenience of its use. Thus the sheet should not be so small as to become trapped in the crevices of the machine or the clothes being washed or so large as to be awkward to package and dispense from the container in which it is sold. For the purposes of the present invention sheets ranging in plan area from 20 square inches to 200 square inches are acceptable, the preferred area lying in the range of from 80 to 120 square inches.

Optional Components

In addition to the peroxy compound precursor, one or more other materials can be applied to the substrate either separately or together with the precursor.

The type and level of such optional, functional components is constrained only by the requirements of unreactivity towards the precursor (if the optional materials are applied so as to be in intimate contact with the precursor) and by the loading limitations of the substrate. As described in more detail hereinafter, materials that are capable of reaction with the precursor can be incorporated in additive products of the present invention but it is essential that the precursor is spatially separate therefrom, ie is disposed at a substrate location that is free or substantially free of the other reactant materials. Individual optional components can be incorporated in amounts up to those corresponding to component:substrate weight ratios of 20:1. However, for processing and product aesthetics reasons, the total weight of optional components per sheet is normally held to a maximum of 10 times the sheet weight, and ideally is less than 5 times the sheet weight, individual components being present at no more than 3 times the sheet weight.

One factor determining the acceptable level of incorporation of an optional ingredient is its physical characteristics ie. whether it is liquid or solid and if solid whether it is crystalline or waxy and of high or low melting or softening point.

The most preferred optional components are solid, water soluble or water dispersible organic adjuvants of a waxy nature having a softening point greater than 40° C. and a melting point less than 80° C. to permit their easy processing.

Where the peroxy compound precursor does not itself have these properties eg. because it is a high melting-point solid, it is preferred to incorporate one or more organic adjuvants as described above to serve as an aid in processing and/or in releasing the precursor from the substrate when the latter is introduced into a wash liquor. The preferred adjuvants serve as plasticizers or thickeners in the corporation of the precursors into or onto the substrate and ideally are non-hygroscopic solids that are mixed with the precursors and melted to provide mixtures having a viscosity of up to 5000 centipoises at 50° C.

Typical solids are polyvinyl pyrrolidone of Mwt. 44000–700,000 preferably 500,000–700,000, tallow alcohol ethoxylates containing from 5 to 30 ethylene oxide groups per mole of alcohol, $C_{12}$–$C_{18}$ fatty acids and certain esters and amides thereof, sorbitan esters of $C_{16}$–$C_{18}$ fatty acids and Polyethylene glycols of Mwt. >4000. As stated hereinbefore preferred materials are those of low hygroscopicity particularly the $C_{14}$–$C_{18}$ saturated fatty acids. liquor. In general, materials serving as processing aids are also suitable as release aids but certain materials, notably $C_{16}$–$C_{18}$ fatty acid and polyethylene glycols of M.Wt. 4,000–6,000, are particularly effective when used in amounts such that the weight ratio of precursors: release aid lies in the range 20:1 to 1:2 particularly 4:1 to 1:1. The benefits of the release aid are most clearly seen for water insoluble precursors such as 2,2-di-(4-hydroxyphenyl) propane diacetate.

A further type of release aid is one that is applied to the substrate either during manufacture or prior to the loading of the substrate by the precursor and any other components. Adjuvants of this type are conventionally fluorocarbons or silicone polymers adapted to modify the surface characteristics of the substrate so as to facilitate the removal of the active components on contact with water. Fluorocarbon treating solutions identified as FC 807 and 808 and available from the 3M Company, Minneapolis, Minnesota, provide improved release when applied in amounts such that the weight ratio of substrate-fluorocarbon solids lies in the range 500:1 to 50:1, preferably about 300:1.

In addition to the foregoing optional components that are of primary value in incorporating the precursor onto, and releasing it from, the substrate detergent ingredients other than inorganic bleaches and compounds reactive towards precursors can be added in admixture with the precursor. Thus, surfactants, suds modifiers, chelating agents, anti-redeposition and soil suspending agents, optical brighteners, bactericides, anti-tarnish agents, enzymatic materials, fabric softeners, antistatic agents, perfumes and bleach catalysts can all be introduced into a wash liquor by means of the additive products of the present invention, subject to the constraints imposed by the loading limitations of the substrate.

In a preferred embodiment of the invention incorporating one or more specified nonionic surfactants for grease and oil removal (to be described hereinafter), the nonionic surfactant or surfactants can serve as a processing aid thereby reducing or even eliminating the need for an additional processing aid.

Certain compounds which are themselves peroxy compound precursors, such as methyl o-acetoxy benzoate, polyazelaic polyanhydride of M.Wt. 1,000-2,000 and succinic acid dinitrile, have the required characteristics for use as processing aids and can be employed as such. Paraffin waxes can also be used in minor amounts. Where the processing aid does not have any other function in the product such as a surfactant component of the grease-removal surfactant mixture, its level of incorporation will be such that the precursor:processing aid weight ratio will be in the range from 20:1 to 1:3, the latter value being for economic reasons. However, the weight ratio of precursor:processing aid can be as low as 1:10 where the processing aid has other functional properties such as surfactancy. A further class of materials useful as a processing aid are the polyacrylamides of molecular weight>500,000 which are thixotropic water soluble polymers that can retain water in the solid state. The organic peroxy compound precursor can be dissolved or dispersed in an aqueous mull of the polymer. The mull is then fed to the substrate web and deposited to impregnate/coat the substrate whereupon it sets as a solid, but water soluble, gel. This particular class of materials is especially valuable for applying the organic peroxy compound precursors to water soluble substrates such as polyvinyl alcohols which tend to lose their water solubility when exposed to elevated temperatures.

As indicated above, the organic adjuvant can serve as a release aid that assists in releasing the precursors from the substrate upon addition of the product to a wash The surfactant can be any one or more surface active agents selected from anionic, nonionic, zwitterionic, amphoteric and cationic classes and mixtures thereof. Anionic surface active agents can be natural or synthetic in origin; nonionic surface active agents can be either semi-polar or alkylene oxide types and cationic surfactants can include amine salts, quaternary nitrogen and phosphorus compounds and ternary sulphonium compounds. Specific examples of each of these classes of compounds are disclosed in Laughlin & Heuring U.S. Pat. No. 3,929,678 issued Dec. 30, 1975 which is hereby specifically incorporated herein by reference.

It has, however, been found that laundry additive products made in accordance with the present invention are particularly suitable for the incorporation of nonionic surfactants useful for grease and oily stain removal. Nonionic surfactants of this type tend to be difficult to incorporate into conventional detergents by reason of their physical characteristics. The spray drying of granular detergents containing nonionic surfactants has given rise to gaseous effluent problems during manufacture because of the volatility of certain nonionic fractions and granular detergents made therewith tend to have less than satisfactory flow properties.

Incorporation of such nonionics in additive products of the present invention permit their utilisation in a laundry wash liquor without any compromise being necessary in the formulation or processing of a conventional detergent granule and a further advantage exists in the potential for pretreatment of oily and greasy stains by direct manual application of the additive product to the stain.

In a preferred aspect of the invention therefore the laundry additive product incorporates at least one nonionic surfactant having an HLB in the range from 8.0 to 17.0 most preferably from about 9.5 to about 15.5 and selected from the group consisting of condensation products of ethylene oxide with a hydrophobic organic molecule having a reactive hydrogen.

Hydrophilic-lipophilic balance or HLB is a widely accepted measure of the polarity of a surfactant and of its relative affinity for aqueous or hydrocarbon media. Developed originally by W. C. Griffin (J. Soc. Cosmetic Chemists 1, 311, 1949) the concept permits numerical values to be given to surfactant materials, the scale being such that hydrophilicity increases with increase in HLB value. For nonionic surfactants containing ethylene oxide the HLB value can be expressed as HLB=E/5, where E is the percentage by weight of ethylene oxide in the compound.

Organic molecules having the desired hydrophobicity and a reactive hydrogen atom include linear and branched chain primary and secondary $C_9$–$C_{15}$ aliphatic alcohols, $C_{12}$–$C_{18}$ alkyl phenols.

Examples of suitable nonionic surfactants are:

| | |
|---|---|
| Linear $C_{14}$-$C_{15}$ alcohol | ($E_7$) |
| $C_{14}$-$C_{15}$ alcohol | ($E_5$) |
| $C_{12}$-$C_{13}$ alcohol | ($E_6$) |
| $C_9$-$C_{11}$ alcohol | ($E_5$) |
| Branched $C_{10}$-$C_{13}$ alcohol | ($E_4$) |
| Linear s-$C_{11}$-$C_{15}$ alcohol | ($E_5$) |
| 11-$C_{15}$ alcohol | ($E_7$) |
| s-$C_{11}$-$C_{15}$ alcohol | ($E_9$) |
| Coconut fatty acid | ($E_5$) |
| Oleic fatty acid | ($E_{10}$) |
| Linear $C_8$ Alkyl phenol | ($E_5$) |
| $C_8$ Alkyl phenol | ($E_8$) |
| $C_9$ Alkyl phenol | ($E_6$) |
| $C_9$ Alkyl phenol | ($E_9$) |
| Sorbitan monooleate | ($E_5$) |
| Sorbitan trioleate | ($E_{20}$) |
| Sorbitan monostearate | ($E_4$) |
| Sorbitan tristearate | ($E_{20}$) |

Particularly preferred materials are the primary linear and branched chain primary alcohol ethoxylates, containing from seven to twenty ethylene oxide groups per mole of alcohol, such as $C_{14}$–$C_{15}$ linear alcohols condensed with 7–15 moles of ethylene oxide available from Shell Oil Co. under the "Neodol" Trade Mark and the $C_{10}$–$C_{13}$ branched chain alcohol ethoxylates obtainable from Liquichimica SA under the "Lial" Trade Mark.

The amount of the nonionic-surfactant mixture is such that the nonionic surfactant:substrate weight ratio lies in the range 20:1 to 1:5, preferably from 10:1 to 1:2, and most preferably from 5:1 to 1:1. In preferred executions using non-woven sheet substrates of approximately 100 sq. ins. plan area and $\approx$3 grs./sheet basis weight, the loading of nonionic-surfactant is in the range 5–15 grs./sheet.

Where the nonionic-surfactant is a liquid at normal temperatures, its physical incorporation can take place in a number of ways. Where the substrate comprises a non-sheet like reticulated foam article, direct impregnation of the article by the surfactant, either alone or with other components of the formulation can be used, employing methods known in the art and described in more detail hereinafter. Where the substrate comprises a non-woven material or a foam article of sheet-like form, it is preferred to mix the surfactant with a compatible non-hygroscopic material of higher melting point, such as the processing aids hereinbefore described to provide a waxy solid in which the surfactant is present in the form of a solid solution and/or as a dispersed phase. The melting point range and waxy nature of polyethylene glycols of molecular weight > 4000 make them useful for this purpose, although their hygroscopicity under extreme conditions of humidity leads to high levels of moisture pick-up if appreciable amounts of such glycols are used. Other useful materials include $C_{12}$–$C_{18}$ fatty acid alkanol-amides. However, the preferred materials are the higher fatty acids, particularly the $C_{16}$–$C_{18}$ saturated fatty acids which are employed in an amount such that the weight ratio of fatty acid to the nonionic component of the surfactant is in the range 1:5 to 4:1, preferably 1:3 to 3:2 and most preferably 2:3 to 1:1.

Where the surfactant is a solid at normal temperature but is molten at a temperature less than about 100° C. preferably less than about 80° C., the surfactant itself can be used as the vehicle for incorporating other non liquid components into the substrate. Surfactants comprising a highly ethoxylated nonionic such as Tallow alcohol ($E_{25}$) or $C_{14\text{-}15}$ primary alcohol ($E_{15}$) are examples of this type.

Other optional ingredients include suds modifiers which can be of the suds boosting, suds stabilising or suds suppressing type. Examples of the first type include the $C_{12}$–$C_{18}$ fatty acid amides and alkanolamides, the second type is exemplified by the $C_{12}$–$C_{16}$ alkyl dilower alkyl amine oxides and the third type by $C_{20}$–$C_{24}$ fatty acids, certain ethylene oxide-propylene oxide copolymers such as the "Pluronic" series, silicones, silica-silicone blends, micro-crystalline waxes, triazines and mixtures of any of the foregoing.

Preferred suds suppressing additives are described in U.S. Pat. No. 3,933,672, issued Jan. 20, 1976, Bartolotta et al., incorporated herein by reference, relative to a silicone suds controlling agent. The silicone material can be represented by alkylated polysiloxane materials such as silica aerogels and xerogels and hydrophobic silicas of various types. The silicone material can be described as siloxane having the formula:

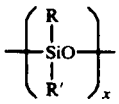

wherein x is from about 20 to about 2,000, and R and R' are each alkyl or aryl groups, especially methyl, ethyl propyl, butyl and phenyl. The polydimethylsiloxanes (R and R' are methyl) having a molecular weight within the range of from about 200 to about 200,000, and higher, are all useful as suds controlling agents. Additional suitable silicone materials wherein the side chain groups R and R' are alkyl, aryl, or mixed alkyl and aryl hydrocarbyl groups exhibit useful suds controlling properties. Examples of the like ingredients include diethyl-, dipropyl-, dibutyl-, methyl-, ethyl-, phenylmethyl- polysiloxanes and the like. Additional useful silicone suds controlling agents can be represented by a mixture of an alkylated siloxane, as referred to hereinbefore, and solid silica. Such mixtures are prepared by affixing the silicone to the surface of the solid silica. A preferred silicone suds controlling agent is represented by a hydrophobic silanated (most preferably trimethylsilanated) silica having a particle size in the range from about 10 millimicrons to 20 millimicrons and a specific surface area above about 50 $m^2$/gm. intimately admixed with dimethyl silicone fluid having a molecular weight in the range from about 500 to about 200,00 at a weight ratio of silicone to silanated silica of from about 19:1 to about 1:2. The silicone suds suppressing agent is advantageously releasably incorporated in a water-soluble or water-dispersible, substantially non-surface-active detergent-impermeable carrier.

Particularly useful suds suppressors are the self-emulsifying siliconesuds suppressors, described in U.S. patent application Ser. No. 622,303, Gault et al, filed Oct. 14, 1975, incorporated herein by reference. An example of such a compoun is DB-544, commercially available from Dow Corning, which is a siloxane/glycol copolymer.

Suds modifiers as described above are incorporated at levels of up to approximately 5%, preferably from 0.1 to 2% by weight of the cationic-nonionic surfactant mixture.

Chelating agents that can be incorporated include citric acid, nitrilotriacetic and ethylene diamine tetra acetic acids and their salts, organic phosphonate derivatives such as those disclosed in Diehl U.S. Pat. No. 3,213,030 issued Oct. 19, 1965, by Roy U.S. Pat. No. 3,433,021, issued Jan. 14, 1968, Gedge U.S. Pat. No. 3,292,121 issued Jan. 9, 1968, Bersworth U.S. Pat. No. 2,599,807 issued June 10, 1952, and carboxylic acid builders such as those disclosed in Diehl U.S. Pat. No. 3,308,067 issued Mar. 7, 1967, all of the foregoing patents being hereby incorporated herein by reference. Preferred chelating agents include nitrilotriacetic acid (NTA), nitrilotrimethylene phosphonic acid (NTMP), ethylene diamine tetra methylene phosphonic acid (EDTMP) and diethylene triamine penta methylene phosphonic acid (DETPMP), and the chelating agents are incorporated in amounts such that the substrate chelating agent weight ratio lies in the range 20:1 to 1:5, preferably 5:1 to 1:5 and most preferably 3:1 to 1:1. Certain polybasic acids have been found to enhance the bleaching effect of organic peroxyacids produced when the products of the present invention are used with conventional detergent composition, examples being EDTMP, NTMP and DETPMP. However, not all chelating polybasic acids are useful in this respect, while certain poorly-chelating polybasic acids, notably succinic acids, and glutaric acid, do show efficacy.

A wide range of fabric softeners and antistatic agents can be included as optional compounds. Exemplary cationic nitrogen compounds include the di-$C_{16}$-$C_{18}$ alkyl, di-$C_1$–$C_4$ alkyl quaternary ammonium salts, imidazolinium salts and non-nitrogenous materials such as the sorbitan esters of $C_{16}$–$C_{18}$ fatty acids and a preferred fabric softening and antistatic composition suitable for incorporation into additive products of the present invention is disclosed in U.S. Pat. No. 3,936,537 issued Feb. 3, 1976 to R. Baskerville & F. G. Schiro. Compounds of this type are disclosed in German patent application OLS No. 2,516,104 published Oct. 30, 1975, specifically incorporated herein by reference.

Preferred enzymatic materials include the commercially available amylases, and neutral and alkaline proteases conventionally incorporated into detergent compositions. Because of their heat sensitivity, these materials require incorporation at or close to ambient temperatures and thus addition to a melt of the precursor and other additives is not possible. Accordingly enzymatic materials are best applied in processes utilising solvent or slurry application of the precursor to the substrate.

Optical brighteners may be anionic or nonionic in type and are added at levels of from 0.05 to 1.0 grs per sheet preferably 0.1 to 0.5 grs per sheet. Preferred examples are the anionic materials available under the trade name "Tinopal EMS" from Ciba Geigy S.A. and Blankophor MBBN available from Farbenfabriben Bayer AG.

Catalysts of use herein are those that enhance the effect of the bleaching species such as certain transition metal salts as disclosed in Wood U.S. Pat. No. 3,532,634 specifically incorporated herein by reference.

The compositions herein comprise a precursor in water-releasable combination with a solid non-particulate substrate. Preferably the substrate is absorbent and the precursor is impregnated therein. Application of the precursor can be carried out in any convenient manner, and many methods are known in the art. For example, the precursor, in liquid form can be sprayed onto a substrate as it is manufactured. Where the precursor is in liquid form, this can be a melt, and it is highly preferable that the precursors melt at a temperature below that at which they decompose on being heated. Where the precursor is a solid at normal temperatures, alternative liquid forms can be used such as solutions in organic solvents which are volatilised after application, and slurries or suspensions of the finely divided solid in water or other liquid media.

As previously indicated, inorganic peroxy bleaches and other materials reactive towards organic peroxy compound precursors can be incorporated in the additive products of the present invention provided that the precursor and the bleach are spatially separated from each other.

In those embodiments in which the precursor and the inorganic peroxygen bleach are incorporated in physically separate locations on the same substrate, a convenient method of application is the deposition of the respective melts, suspensions or solutions as discrete bands of material on the substrate. Preferably the bleach is applied as a dispersion of solid particles in a molten processing aid (as hereinbefore described) at a temperature in the range 40° to 60° C. Using this technique, bleach: substrate weight ratios of up to 15:1 can be obtained. This level of loading is attainable with cellular substrates but substrates of fibrous character are limited in practice to weight ratios of about 5:1. Furthermore, loading limitations imposed by the substrate surface area required for the incorporation of the precursor may limit the amount of bleach to less than 6:1. Provision must also be made for the separation of the bands or areas of bleach and the corresponding bands or areas of precursor during transport and/or storage. This is achieved by interposing layers of material between the layers of substrate or by producing patterns of deposited material that are not coincident on stacking of the substrate.

Where the substrate is impregnated, it is believed that the surfaces of the pores or fibres making up the substrate are themselves coated and it is a highly desirable aspect of the substrate that it permits an extensive coating of the peroxy compound precursor to be formed. The term "coating" connotes the adjoining of one substrate to the surface of another; "impregnation" is intended to mean the permeation of the entire substrate structure, internally as well as externally. One factor affecting a given substrate's absorbent capacity is its free space. Accordingly, when a precursor is applied to an absorbent substrate, it penetrates into the free space, hence, the substrate is deemed impregnated. The free spaces in a substrate of low absorbency, such as a one-ply kraft or bond paper, is very limited; such a substrate is, therefore, termed "dense". Thus, while a small portion of the precursor penetrates into the limited free space available in a dense substrate, a rather substantial balance of the precursor does not penetrate and remains on the surface of the substrate so that it is deemed a coating.

In one method of making a precursor-impregnated sheetlike substrate, the precursor is applied to absorbent paper or non-woven cloth by a method generally known as padding. The precursor is preferably applied in liquid form to the substrate and precursors which are normally solid at room temperature should first be melted and/or solvent-treated. Methods of melting the precursor and/or of treating the precursor with a solvent are known and can easily be carried out to provide a satisfactorily treated substrate.

In this method, the precursor, in liquid form, is placed into a pan or trough which can be heated, if necessary, to maintain the precursor in liquid form. To the liquid precursor is then added any desired additive. A roll of absorbent substrate is then set up on an apparatus so that it can unroll freely. As the substrate unrolls, it travels downwardly and, submersed, passes through the pan or trough containing the liquid precursor at a slow enough speed to allow sufficient impregnation. The absorbent substrate then travels, at the same speed, unwardly and through a pair of rollers which squeeze off excess bath-liquid. The impregnated substrate is then cooled to room temperature, after which it can be folded, cut or perforated at uniform lengths, and subsequently packaged and/or used.

The rollers used resemble "squeeze rolls" used by those in the paper and paper-making art; they can be made of hard rubber or steel. Preferably, the rollers are adjustable, so that the orifice between their respective surfaces can be regulated to control the amount of the precursor liquid on the substrate.

In a preferred execution of the invention, the precursor in liquid form, is sprayed onto absorbent substrate as it unrolls. The unrolled substrate web is arranged to slide over the spray nozzle which comprsises a horizontally disposed tube formed with a slit extending along its top surface. The molten slurry of organic peroxy compound precursor and any additives mixed herewith is forced through the slit into the substrate and the excess liquid is then squeezed off by the use of squeeze rollers. A melt temperature in the range of 40°-80° C. preferably 45°-65° C. is used and the molten material should have a viscosity of less than 5000 centipoises at 50° C., preferably no more than 500 centipoises.

Other variations include the use of metal "nip" rollers onto the leading or entering surfaces of which the precursor is sprayed, which variation allows the absorbent paper to be treated. usually on one side only, just prior to passing between the rollers wherein excess liquid is squeezed off. This variation additionally involves the use of metal rollers which can be heated to maintain the precursor in the liquid phase. A further method involves separately treating a desired number of the individual plies of a multi-ply paper and subsequently adhesively joining the plies with a known adhesive-joiner compound; this provides a composition which can be treated on one of its outer sides, yet contains several other plies, each of which is treated on both sides.

In the preferred method of producing the products of the present invention a mixture of the molten activator and any added materials is applied to the substrate. In order to provide a mixture having suitable characteristics ie. solidification over a range of temperature to give a waxy rather than a crystalline solid, certain of the activators suitable for the purposes of the invention need to be blended with a plasticising or thickening agent. For this purpose the peroxy compound precursors can be divided into three different types, namely:

(a) those that are liquid at temperatures up to 25° C. or are solids melting between 25° C. and 40° C.

(b) solids melting between 40° C. and 95° C., (c) solids melting above 95° C.

In the higher melting solid group it is preferred that the melting point be less than 150° C. although materials having melting points up to 250° C. can be processed by handling as a dispersion in a melt of another material. Of course it should be appreciated that the organic peroxy compound precursor should not decompose to any substantial extent at temperatures below its melting point.

Melting points of a number of peroxyacid precursors suitable for use in the present invention are shown in the table below:

| MATERIAL | MPT |
|---|---|
| N-acetyl caprolactam | Liq |
| N-methyl diacetamide | Liq |
| Acetic anhydride | Liq |
| Benzoyl imidazole | Liq |
| Ethyl o-acetoxy benzoate | Liq |
| Benzyl o-acetoxy benzoate | 25° C. |
| Benzoic anhydride | 40° C. |
| Methyl o-acetoxy benzoate | 49° C. |
| p-acetoxy acetophenone | 52° C. |
| Polyazelaic polyanhydride | 55° C. |
| Succinic acid dinitrile | 55° C. |
| Tetra acetyl hexamethylene diamine | 59° C. |
| 2,2-di-(4-hydroxyphenyl) propane diacetate | 79° C. |
| 1-cyclo hexyl, 3-acetyl hydantoin | 86° C. |
| Tetra acetyl methylene diamine | 94° C. |
| Phenyl o-acetoxy benzoate | 97° C. |
| N-acetyl imidazole | 102° C. |
| Diacetyl dimethyl glyoxime | 112° C. |
| Triacetyl guanidine | 112° C. |
| o-acetoxy benzoic acid | 135° C. |
| 1-phenyl 3 acetyl hydantoin | 147° C. |
| Tetra acetyl ethylene diamine | 148° C. |
| Tetra acetyl glycouril | 237° C. |
| Sodium Acetylphenol sulphonate | Very High |

For the liquid and low melting point peroxy compound precursors a higher melting water soluble or dispersible organic adjuvant is required which has a range of temperatures over which it softens and melts. This adjuvant serves to provide a mixture having the desired visocisty/temperature characteristics. As previously stated, such a material should also be non-hygroscopic in character. Examples of such materials are polyvinyl pyrrolidone of molecular weight 44,000–700,00 and polyazelaic polyanhydride (itself an activator) of MWt 1,000–2,000 and polyethylene glycols of MWt greater than about 4,000. Other materials that can be used include sorbitan esters of long chain fatty acids such as myristic, stearic and arachidic acids and non-hygroscopic ethoxylated derivatives of tallow alcohol.

The level of usage of the high melting point processing adjuvant will of course depend on the usage level of the peroxy compound precursor, its melting point and its solubility in the adjuvant. The adjuvant:precursor ratio can approach 10:1 by weight although the constraints imposed by the type of substrate material used may limit the permissible loading on the substrate to less than this.

High melting point peroxy compound precursors require an adjuvant that will lower the melting point of the mixture to a value in the desired range ie. 40° C.–80° C. preferably 45°–65° C. The adjuvant should be non-hygroscopic and the precursor should dissolve or form a stable dispersion in the adjuvant. A mixture in which part of the precursor is dissolved and the excess dispersed as a suspension is quite satisfactory. Materials suitable for this function include those mentioned above together with $C_{12}$–$C_{20}$ fatty acids and certain water-soluble and water-dispersible esters thereof.

As indicated above, the adjuvant:precursor weight ratio can have a value of up to 10:1 but may be limited to values less than this by substrate loading constraints.

For precursor materials melting in the optimum range ie. 40° C.–80° C. an organic adjuvant is not essential as a processing aid in the preferred method of manufacture of products in accordance with the invention. Such materials can be melted and applied directly to the substrate and indeed may be used as carriers themselves for other components of the products such as solid chelating agents or liquid nonionic surfactants. However adjuvants of a waxy character may still be utilised in order to provide robustness to the process, for example by reducing dust, to ensure a rapid rate of release and dissolution of the precursor in aqueous media, and/or to modify the surface characteristics of the treated substrate.

In use, the additive products of the present invention are introduced into the washing liquor at a point in the washing process where formation of an organic peroxy bleaching species is of most value. In practice optimum results are obtained, irrespective of the washing cycle being employed, when the additive products of the present invention are fed into the machine at the same time as the fabric load. For machines, including a prewash cycle, addition of the additive product at the beginning of the main wash cycle is preferred.

The invention is illustrated in the following nonlimitative examples in which parts and percentages are by weight unless otherwise specified. Reference herein to a test method for assessing the efficacy of peroxy compound precursors in forming organic peroxy bleaching species is to the procedure as set out below.

ACTIVATOR PERHYDROLYSIS TEST 1 m. Mole of the peroxy compound precursor* is added to a stirred solution of sodium perborate tetrahydrate (0.9 gram) sodium pyrophosphate decahydrate (1.25 grams) EDTA (35 ppm) and 0.25 g. sodium tetrapropylene benzene sulphonate in 500 mls of distilled water maintained at 25° C. by a circulating water bath and stirred mechanically.

* Water soluble precursors can be added directly. Other materials can be predissolved in 10 mls of a suitable solvent which will not react with the species present eg. 1,4 dioxan. In such cases the volume of distilled water should be reduced to 490 mls.

Within twenty minutes of the addition of the precursor at least one 10 ml aliquot is withdrawn and each aliquot added to a mixture of cracked distilled water ice and distilled water (100 grams) and glacial acetic acid (15 mls). Potassium iodide (0.05 grams) is added and the mixture is immediately titrated with 0.01 Molar sodium thiosulphate solution using an iodine indicator ('Iotect' available from British Drug Houses Limited) to the first end point (blue/black→colourless). Precursors which require a titre of greater than 2 mls of 0.01M sodium thiosulphate are preferred materials for the purpose of the present invention.

EXAMPLE 1

Methyl-o-acetoxybenzoate (MOAB) (Mpt 49° C.) was melted and held at a temperature of 60° C. A 9"×11" substrate sheet was prepared from a roll of randomly-laid regenerated cellulose fibres of gauge 3 denier, bonded with a polyvinyl acetate binder (70% cellulose, 30% binder solids) and having a basis weight of 1.9 grs/sheet. The substrate was impregnated by immersion in the melt and surplus precursor removed by passing the sheet between a pair of rolls one of which was rubber faced and the other was heated stainless steel. The sheet was then cooled to solidify the precursor and weighed and found to have a loading of 6.0 grs/sheet ie. a precursor to substrate weight ratio of 3.1:1. The sheet had a crisp feel and could be formed into a roll of 4 cm. diameter without difficulty.

Sheets produced in accordance with the foregoing example were utilised in a test in which the bleaching performance of three products were compared. The three products were A. A commercially available granular laundry detergent containing 28% sodium perborate.

B. A 'standard' low temperature bleach laundry product comprising Formulation A with 10% sodium perborate replaced by 6% of a commercially available organic peroxy compound precursor +4 % sodium sulphate.

C. Formulation A with a sheet of Example 1.

Each product was added to a washing machine containing 4 lbs of soiled clothes in 30 liters of water of 18° Clark hardness to give a granular product concentration of 0.50%. On this basis 9 grs of the precursor was added in Product B compared to 6.0 grs of MOAB On the sheet added with product C.

Swatches of white cotton and a 50/50 polyester-cotton blend were stained with wine and tea stains and the stained swatches were added to the loads and washed in each formulation at temperatures of 40° C. and 60° C. for 15 and 25 minutes respectively. In each test, formulations B and C both gave significantly better stain removal than formulation A and formulation C was not significantly different from formulation B.

This result demonstrates that a representative additive product of the present invention, when added to a conventional laundry detergent liquor, provides equivalent bleaching to a detergent formulation containing inorganic peroxy bleach and a standard organic peroxy bleach precursor. Moreover this bleaching performance is obtained without the attendant pinpoint spotting colour damage associated with granular organic peroxy bleach products.

Comparable bleaching results to that given by Product C above are obtained when sheets are used in which the methyl o-acetoxy benzoate is replaced by benzoic anhydride, phenyl benzoate or maleic anhydride.

EXAMPLE 2

A melt of methyl o-acetoxybenzoate was prepared and applied, using the technique of Example 1, to a substrate comprising 100% non-bleached randomly-laid rayon fibres of denier 5.5, bonded with an ethyl acrylate binder, (Rhoplex HA8) (70% fibres 30% binder) to give a basis weight of 1.55 grs per 11"×9" sheet. After excess molten material had been removed from the substrate and it had been allowed to cool, the precursor loading was found to be 3.9 grs, ie. a precursor:substrate weight ratio 2.5:1. The sheet had a crisp feel.

A satisfactory product is obtained when the rayon fibre substrate is replaced by a hydrophilic polyurethane foam sheet made from "Hydrofoam" (Registered Trade Mark), having density of 0.596 grs per cubic inch and a cell count of 60-80 per inch.

EXAMPLE 3

A melt comprising a dispersion of 50% o-acetoxybenzoic acid (Mpt 135° C.) in 50% myristic acid was prepared at a temperature of 70° C. The melt was applied using the technique of Example 1 to a non-woven substrate comprising 100% non-bleached radomly-laid rayon fibres having a denier of 3.0 and bonded with an ethyl acrylate binder (Rhoplex HA8) (70% fibres 30% binder) to give a basis weight of 1.6 grs/sheet. The loading of the melt on cooling was found to be 5 grams per sheet, thus giving a precursor:substrate ratio of 1.6:1. The treated sheet was smooth and flexible.

Products having satisfactory characteristics are obtained when the melt comprises a dispersion of 50% phenyl o-acetoxybenzoate in 50% polyethylene glycol 6000; 40% diacetyl dimethyl glyoxime, 60% polyethylene glycol 6000; 75% tetracetyl methylene diamine, 25% polyvinyl pyrrolidone of molecular weight 700,000; 40% o-acetoxy benzoic acid, 60% myristic acid; 30% tetracetyl glycouril, 70% myristic acid; 60% phthalic anhydride, 40% polyazelaic polyanhydride of molecular weight 1500. Equivalent bleaching results to those of Product C in Example 1 are obtained when the sheets are used in a washing liquor containing a sodium perborate or percarbonate-containing laundry detergent.

EXAMPLE 4

A mixture of 85% methyl o-acetoxybenzoate and 15% polyethylene glycol 6000 was prepared and melted at 60° C. The melt was pumped to an extrusion nozzle having a slit orifice extending horizontally laterally under a moving web of the substrate material of Example 2 which was unrolled at a speed of 80 ft/minute. The melt was extruded so as to impregnate the material over its entire width and spreading of the molten material was further assisted by passage of the treated substrate through a pair of rolls located immediately downstream of the extrusion nozzle. The treated substrate web was cooled by passage over further cooling rolls before being collected on a storage reel and removed for cutting and packaging. The loading achieved per 99 sq. ins. sheet area was 6.1 grs ie. a precursor:substrate ratio of 3.3:1.

A satisfactory product is obtained when the loading of the precursor is increased to 13.2 grs ie. a precursor: substrate ratio of 8.5:1. A smooth waxy product is also obtained with a melt of total weight 7g comprising a blend of 10% MOAB and 90% sorbitan monostearate ie. a precursor:substrate ratio 1:2.2 and a precursor:adjuvant ratio of 1:9. Comparable results are obtained when the methyl o-acetoxy benzoate is replaced by succinic acid dinitrile, maleic anhydride or polyazelaic polyanhydride.

Satisfactory products are also obtained when the sorbitan monostearate is replaced by a mixture comprising 60% tallow alcohol condensed with 30 moles of ethylene oxide, 20% ditallowyl dimethyl ammonium chloride and 20% sorbitan monostearate.

EXAMPLE 5

The same procedure as in Example 4 was followed save that the melt comprised a blend of 86.5% methyl-o-acetoxy benzoate and 13.5% myristic acid. A loading of 6.6 grs/99 sq. ins. was obtained giving a precursor:-substrate ratio of 3.1:1. The web had a smooth waxy feel and was very flexible.

EXAMPLE 6

The procedure of Example 5 was followed save that the melt comprised a blend of 86.5% methyl-o-acetoxy benzoate and 13.5% myristic acid. A loading of 6.6 grs/99 sq. ins. was obtained giving a precursor:substrate ratio of 2.6:1 and a flexible product.

Addition of 0.5% grs of succinic acid to the above melt provides a product having a smoother surface texture. The methyl o-acetoxy benzoate-myristic acid melt is replaced by a 25% N-acetyl caprolactam, 75% myristic acid melt (solid at 40° C.) and a smooth waxy product is obtained with the same melt loading.

EXAMPLE 7

The procedure of Example 3 was followed except that the myristic acid was replaced by a mixture of equal parts of sorbitan monostearate and polyethylene glycol 6000. A smooth flexible sheet product was obtained with a loading of 5 grams of melt per sheet ie. a precursor:substrate ratio of 1.6:1.

Similar results were obtained when 4.5 parts of the myristic acid of Example 3 was replaced by 4.5 parts of a paraffin wax of Mpt 55° C.

EXAMPLE 8

A mixture consisting of 95% methyl o-acetoxybenzoate and 5% polyvinyl pyrrolidone of molecular weight 700,000 was melted to give a liquid approximately of viscosity 170 centipoises at 60° C. 0.1 wt % of perfume was added to this mixture which was kept molten at a temperature of 60°-70° C. in an electrically heated bath. A continuous web of substrate was arranged such that a loop of the roll passed downwardly into and then upwardly out of the bath so as to impregnate the web, the web being drawn through the bath by a set of adjustable pinch rolls located above the bath. One roller was rubber faced and the other was made of stainless steel and was heated.

The substrate comprised a non-woven 100% regenerated cellulose web formed of fibres of 3 denier gauge bonded with polyvinyl acetate (70% fibres 30% binder) to give a basis weight of 1.55 grs/oo sq. ins. The web thickness was 0.005 inches.

With a hot roll temperature of 50°-70° C. and a web feed rate of 1 meter/minute a sheet product was obtained with a loading of 6 grs/99 sq. ins. ie. a precursor/substrate ratio of 3.7:1. On being cooled the sheeted product had a smooth feel and a flexible handle.

EXAMPLE 9

Preparation of 2,2-di(4-hydroxyphenyl) propane diacetate 228 grs. (1 mole) of 2,2-di (4-hydroxyphenyl) propane (Bisphenol A available from Shell Chemical Co., Manchester, England) were dissolved in 1 liter of glacial acetic acid at 20° C. 1 ml. of 98% sulphuric acid was added to the solution and 255 grs. (2.5 moles) of acetic anhydride were added slowly with stirring over a period of 30 minutes. On completion of the addition, the product was poured into an excess of water and the resulting precipitate filtered, washed with water and dried. The product had a melting point of 79°-80° C. and its IR spectrum showed a peak at a wavelength of 1750 $cm^{-1}$ characteristic of acetyl grouping. NMR spectroscopy demonstrated the presence of two acetyl groups.

The Perhydrolysis Test specified previously was carried out on 0.228 grs. (1m mole) of the above product and a titre of 3.9 ml. 0.1N Sodium Thiosulphate was obtained on a sample taken 5 minutes after addition of the precursor to the sodium perborate solution.

100 grs. of Bisphenol A diacetate prepared as above and 100 grs. of Polyethylene glycol 6000 were mixed and heated to approximately 90° C. to form a melt. This was then applied to a regenerated cellulose substrate sheet of basis weight 1.65 gr. using the technique of Example 9 to give a loading of 11.0 grs., ie. a precursor/substrate ratio of 3.33:1.

In the above example of Bisphenol A diacetate is replaced by a 50:50 mixture of Bisphenol A diacetate and N-benzoyl Imidazole (Mpt. 202° C.) which is subject, as a molten dispersion, to comminution in a Premier colloid melt to give a particle size of less than 50μ, prior to application to the substrate. An equivalent product is obtained.

In the above example, similar results are obtained if the polyethylene glycol 6000 is replaced by stearic acid, tallow alcohol condensed with 25 moles of ethylene oxide of a mixture thereof.

EXAMPLE 10

A 10"×10" non-woven sheet comprising 70% by weight regenerated cellulose fibres and 30% ethyl acrylate binder with a basis weight of 1.6 grs./sheet, was impregnated with a mixture of 5 grs. sodium para-acetoxy benzene sulphonate, 1 gr. of ethylene diamine tetra methylene phosphonic acid and 5 grs. of lauric acid at a temperature of 55° C. and adding the remaining ingredients to form a slurry into which the sheet was then dipped. The impregnated sheet was then passed between a set of rolls to remove the excess mixture. A loading of 11 grs. was obtained, ie. a precursor-substrate weight ratio of 3.12:1.

If the sodium o-acetoxy benzene sulphonate is replaced by a 50/50 mixture of benzoic anhydride and methyl-o-acetoxy benzoate or by tetra acetyl ethylene diamine, Bisphenol A diacetate, 1,3,5-triacetyl 2,4,6-triazine, p-acetoxy acetophenone or diacetyl dimethyl glyoxime, an equivalent product is obtained.

If the EDTMP is replaced by NTMP, succinic acid or diethylene triamino penta methylene phosphonic acid, similar results are obtained.

EXAMPLE 11

The procedure of Example 13 was followed to provide a blend of 5 grs. of Bisphenol A diacetate, 5 grs. of polyethylene Glycol 6000 and 1 gr. of ethylene diamine tetra methylene phosphonic acid on a 10"×10" regenerated cellulose sheet substrate of basis weight 1.6 grs./sheet. The sheet product had a smooth even texture and was flexible in nature.

EXAMPLE 12

Laundry additive products A & B in accordance with the present invention are made up as follows using the procedure of Example 13.

| A | | B | |
|---|---|---|---|
| EDTMP | 1 gr | EDTMP | 1.5 gr |
| TAED | 4 gr | TAED | 5 gr |
| Stearic Acid | 2 gr | Lauric Acid | 3 gr |
| $TAE_{25}$ | 2 gr | $TAE_{25}$ | 3 gr |
| | | Methyl vinyl ether maleic anhydride copolymer M.Wt. 250,000 | 1 gr |
| | 9 gr | | 13.5 gr |
| Substrate: Non woven regenerated cellulose fibre sheet containing 30% by wt. ethyl acrylate binder. Basis weight 1.6 grs/100 sq. ins. | | Substrate: Non woven regenerated cellulose fibre sheet (1.5 denier)containing 30% by wt. ethyl acrylate binder. Basis wt. 3.25 grs/100 sq. ins. | |

In each case a melt of the carboxylic acid and alcohol ethoxylate is made and the remaining ingredients incorporated therein as a dispersion which is then applied to the substrate.

EXAMPLE 13

50 parts of tetra acetyl hexmethylene diamine (TAHD) are melted at 70° C. and mixed with 50 parts of Dobanol (RTM) 45E15 and 10 parts of the sodium salt of ethylene diamine tetra methylene phosphonic acid. This mixture is used to impregnate a non woven fibrous substrate using the procedure of Example 4 so as to give a laundry additive product having the composition

| | |
|---|---|
| TAHD | 5 gr |
| Dobanol 45E15 | 5 gr |
| EDTMP | 1 gr |
| Substrate | 1.58 gr |
| (precursor:substrate weight ratio 7.1:1) | |

The substrate comprises 100% non-bleached randomly-laid rayon fibres of denier 5.5 bonded with an ethyl acrylate binder (Rhoplex Ha8) (70% fibres 30% binder) to give a basis weight of 1.55 grs per 100 sq. ins.

A similar product is obtained with a substrate comprising 100% non-bleached randomly-laid rayon fibres having a denier of 3.0 and a basis weight of 1.6 grs/100 sq ins.

An equivalent product is obtained if the EDTMP is replaced by diethylene triamino penta methylene phosphonic acid (DETPMP) or nitrilo trimethylene phosphonic acid (NTMP).

EXAMPLE 14

A mixture of 40 parts of tetraacetyl ethylene diamine (TAED) in 60 parts of polyethylene glycol 6000 is melted at 60° C. and agitated to form a dispersion. To this mixture is added 40 parts of Dobanol 45E7 (HLB 12.3) (a substantially linear $C_{14}$-$C_{15}$ primary alcohol condensed with an average of 7 moles of ethylene oxide supplied by Shell Oil Company) and 8 parts of the sodium salt of ethylene diamine tetramethylene phosphonic acid. This mixture is then fed to a holding tank provided with heating and agitation from which it is then pumped to an impregnating head for application to the substrate.

The substrate is in the form of a continuous web of 10" wide reticulated hydrophilic polyurethane foam of basis weight density 20 kg/m$^3$ and thickness 3 mm $\mu$. The web is held on a reel and is passed over a series of driven and idler rolls between two of which the web travelled in a horizontal path past the impregnating head. The impregnating head comprises a horizontally extending laterally disposed pipe and overlying the web, the pipe being formed with a longitudinal slot extending just less than the width of the web and in contact therewith. After application of the molten mixture the impregnated web is cooled by means of air jets and is then wound on to a storage reel for subsequent removal and cutting into individual sheets.

Using this technique individual sheets of size 9"×4" have a product loading of 18.5 grs of product ie. 5 grs of TAED, 5 grs of nonionic surfactant, 7.5 grs of PEG 6000 and 1 gr of EDTMP. The sheets are smooth to the touch.

A similar product is obtained when the nonionic surfactant is replaced by Dobanol 45E9, Tergitol 15-S-7 a linear $C_{11}$-$C_{15}$ secondary alcohol heptaethoxylate (supplied by Union Carbide Corp) and Lial 169E11 (a highly branched primary $C_{16}$-$C_{19}$ alcohol condensed with eleven molecules of ethylene oxide per mole of alcohol supplied by Liquichimica SA). A similar product is also obtained when the PEG 6000 is replaced by Tallow alcohol condensed with 25 moles of ethylene oxide per mole of alcohol. A similar product is obtained if the TAED is replaced by diacetyl dimethyl glyoxime, tetra acetyl glycouril or sodium p-acetoxy benzene sulphonate.

EXAMPLE 15

50 parts of tetra acetyl ethylene diamine (TAED) are mixed with 40 parts of Dobanol 45E7 10 parts of polyethylene glycol 6000 and 50 parts of stearic acid and heated to 70° C. and 10 parts of the sodium salt of ethylene diamine tetra methylene phosphonic acid are added. The mixture is used to impregnate the non woven fibrous substrate B of Example 12 using the procedure of Example 1 so as to give a laundry additive product having the composition

| | |
|---|---|
| TAED | 5 gr |
| Dobanol 45E7 | 4 gr |
| EDTMP | 1 gr |
| PEG 6000 | 1 gr |
| Stearic acid | 5 gr |
| Substrate | 3.25 gr |
| (precursor: substrate weight ratio 1.54:1) | |

A similar product is obtained with a substrate comprising 100% non bleached randomly laid rayon fibres having a denier of 3.0 and a basis weight of 1.6 grs/100 sq. ins.

An equivalent product is obtained if the EDTMP is replaced by Diethylene triamino penta methylene phosphonic acid (DETMP) or nitrilo trimethylene phosphonic acid (NTMP).

EXAMPLE 16

100 parts of a 1:1 mixture by weight of tetra acetyl hydrazine (TAH) and Lial 125E4 (a highly) branched $C_{12}$-$C_{15}$ primary alcohol condensed with 4 molecules of ethylene oxide per mole of alcohol and supplied by Liquichimica SA) are heated to a temperature of 85° C. 20 parts of Polyethylene glycol 6000 are added together with 15 parts of nitrilo trimethylene phosphonic acid. The mixture is pumped to a hold tank and the procedure of Example 1 is followed to impregnate a polyether foam substrate of density 20 kg/m$^3$ and 3 mm thickness.

An 9"×4" sheet of the impregnated foam is found to comprise

| | |
|---|---|
| TAH | 5 grs |
| Lial 12SE4 | 5 grs |
| NTMP | 1.5 grs |
| PEG 6000 | 2.0 grs |

Equivalent results are obtained if the TAH is replaced by p-acetoxy acetophenone, methyl o-acetoxy bezoate or 2,2-di-(4-hydroxphenyl) propane diacetate.

EXAMPLE 17

A 12"×10" non woven sheet comprising a bonded polyester-wood pulp mixture available from Chicopee Manufacturing Co., Milltown New Jersey, USA under the Code Name SK 650 WFX 577, having a basis weight of 50 grs/sq meter was impregnated with a mixture of 5 grs TAED and 1 gr EDTMP dispersed in a mixture of 6 grs Dobanol 45 E7 and 6 grs Polyethylene glycol 6000 using the method of Example 4. The impregnated product was sufficiently rigid to be self supporting when supported horizontally at one edge and had a smooth waxy feel.

A satisfactory product was also obtained when the substrate was replaced by a 9"×4" polyurethane foam sheet of density 20 km/m$^3$, thickness 3 mm, the product loading per sheet being 18 grs.

Similar products to the above are obtained if the TAED is replaced by any one of the following; p-acetoxy acetophenone, 1,3,5-triacetyl 3,4,6 triazine, diacetyl dimethyl glyoxime, 2,2,-di-(4-hydroxphenyl) propane diacetate, tetraacetyl hexamethylene diamine, tetraacetyl hydrazine, methyl o-acetoxybenzoate, or tetraacetyl glycouril.

We claim:

1. A method of making a laundry additive product for use as a bleaching aid, comprising the steps of (a) forming a fluid mass containing organic peroxy bleach precursor; said organic peroxy bleach precursor being organic compound which is capable of reacting in aqueous washing liquor with inorganic peroxy bleach selected from the group consisting of alkali metal percarbonate, persilicate and perpyrophosphate bleaches to form organic peroxy bleach having a bleaching performance at least equivalent to that of the inorganic peroxy bleach;

(b) contacting flexible solid means with said fluid mass; said flexible solid means being suitable as a substrate for solidified fluid mass;

(c) causing fluid mass to solidify on said flexible solid means to provide a precursor:flexible solid means weight ratio lying within the range from about 30:1 to about 1:10; thereby forming laundry additive product for use as a bleaching aid consisting essentially of peroxy bleach precursor attached to flexible substrate and releasable in aqueous washing liquor by solution, dispersion, bleaching, softening or melting to react with said inorganic peroxy bleach to form said organic peroxy bleach.

2. A method as recited in claim 1, in which the organic peroxy bleach precursor is a peroxycarboxylic acid bleach precursor.

3. A method as recited in claim 1, in which the organic peroxy bleach precursor is selected from the group consisting of imides of general formula $$R_1-\overset{\overset{\displaystyle O}{\|}}{C}-\overset{\overset{\displaystyle X}{|}}{N}-\overset{\overset{\displaystyle O}{\|}}{C}-R_2$$

wherein $R_1$ and $R_2$ are independently selected from the group consisting of $C_1$–$C_4$ alkyl radicals and X is selected from the group consisting of $C_1$–$C_6$ alkylene radicals substituted with a diacylated nitrogen atom, and in which the flexible solid means is a flexible fibrous sheet.

4. A method as recited in claim 1 comprising additionally the step of including chelating agent in the fluid mass in an amount sufficient to provide a chelating agent:flexible solid means weight ratio lying within the range from about 5:1 to about 1:20.

5. A method as recited in claim 1 comprising additionally the step of including surface active agent in the fluid mass.

6. A method as recited in claim 1 comprising additionally the step of including anti-redeposition agent in the fluid mass.

* * * * *

UNITED STATES PATENT AND TRADEMARK OFFICE

CERTIFICATE OF CORRECTION

PATENT NO. : 4,179,390

DATED : December 18, 1979

INVENTOR(S) : Gianfranco Luigi Spadini et al

It is certified that error appears in the above-identified patent and that said Letters Patent are hereby corrected as shown below:

Column 5, line 2, "5 1" should be --5--.

Column 16, line 16, "corporation" should be --incorporation--.

Column 28, line 35, "of a mixture" should be --or a mixture--.

(claim 1) Column 32, line 3, after "metal" insert --perborate,--.

(claim 1) Column 32, line 17, "bleaching" should be --leaching--.

Signed and Sealed this

*Eleventh* Day of *March 1980*

[SEAL]

*Attest:*

SIDNEY A. DIAMOND

*Attesting Officer*

*Commissioner of Patents and Trademarks*